United States Patent [19]

Wynne

[11] 4,123,617

[45] Oct. 31, 1978

[54] ELECTRIC ARC FURNACE

[75] Inventor: Peter J. Wynne, Pittsburgh, Pa.

[73] Assignee: Lectromelt Corporation, Pittsburgh, Pa.

[21] Appl. No.: 793,754

[22] Filed: May 4, 1977

[51] Int. Cl.[2] ..... F27B 14/02

[52] U.S. Cl. ..... 13/10

[58] Field of Search ..... 13/10; 266/245, 246; 432/157

[56] References Cited

U.S. PATENT DOCUMENTS

| | | | |
|---|---|---|---|
| 2,472,954 | 6/1949 | Moore | 13/10 X |
| 2,944,100 | 7/1960 | Sorg et al. | 13/10 |

*Primary Examiner*—R. N. Envall, Jr.

*Attorney, Agent, or Firm*—Fred Wiviott

[57] ABSTRACT

An electric arc furnace has a body mounted on a pivotable platform and electrodes which extend through a furnace cover. A gantry supports the cover and electrode and is mounted on a rail for swinging movement onto and off of the platform to move the cover and electrodes from above the furnace body to a remote position. A pair of support columns are mounted below the edge of the platform over which the gantry moves and each column is pivotal into and out of a vertical supporting position to permit the platform to pivot. Shock absorbers limit pivotal movement of the platform in each direction and cushion engagement between the platform and the columns.

11 Claims, 6 Drawing Figures

ELECTRIC ARC FURNACE

BACKGROUND OF THE INVENTION

Electric arc furnaces commonly include a furnace body comprising a metallic shell and a refractory lining which define a hollow enclosure along with a removable cover through which one or more electrodes extend. Such furnaces are often mounted on a platform which pivots about a horizontal axis for pouring molten metal upon pivotal movement in one direction and for deslagging upon pivotal movement in an opposite direction. The furnace cover and electrodes are generally supported for swinging movement from a position above the furnace body to a remote position so that the furnace may receive a charge, usually pellets or scrap. In larger size furnaces, the roof and electrodes a remounted on a gantry which is supported on tracks extending to the edge of the platform on one side of the pivot axis and resume on an adjacent support floor. Because of the weight of the gantry moving over the platform edge, it is necessary to support the platform beneath its edge without interfering with pivotal movement.

SUMMARY OF THE INVENTION

An object of the invention is to provide a new and improved support for a pivotally mounted electric arc furnace.

Another object of the invention is to provide at the edge of a pivotally mounted electric arc furnace platform means for supporting the weight of the furnace roof and electrode support gantry and which does not interfere with platform pivotal movement.

A further object of the invention is to provide a pivoting electric arc furnace platform with means to cushion the impact of the platform as it pivots between its various positions.

These and other objects and advantages of the present invention will become more apparent from the detailed description thereof taken with the accompanying drawings.

DETAILED DESCRIPTION OF THE PREFERRED EMBODIMENT

Figure 1:
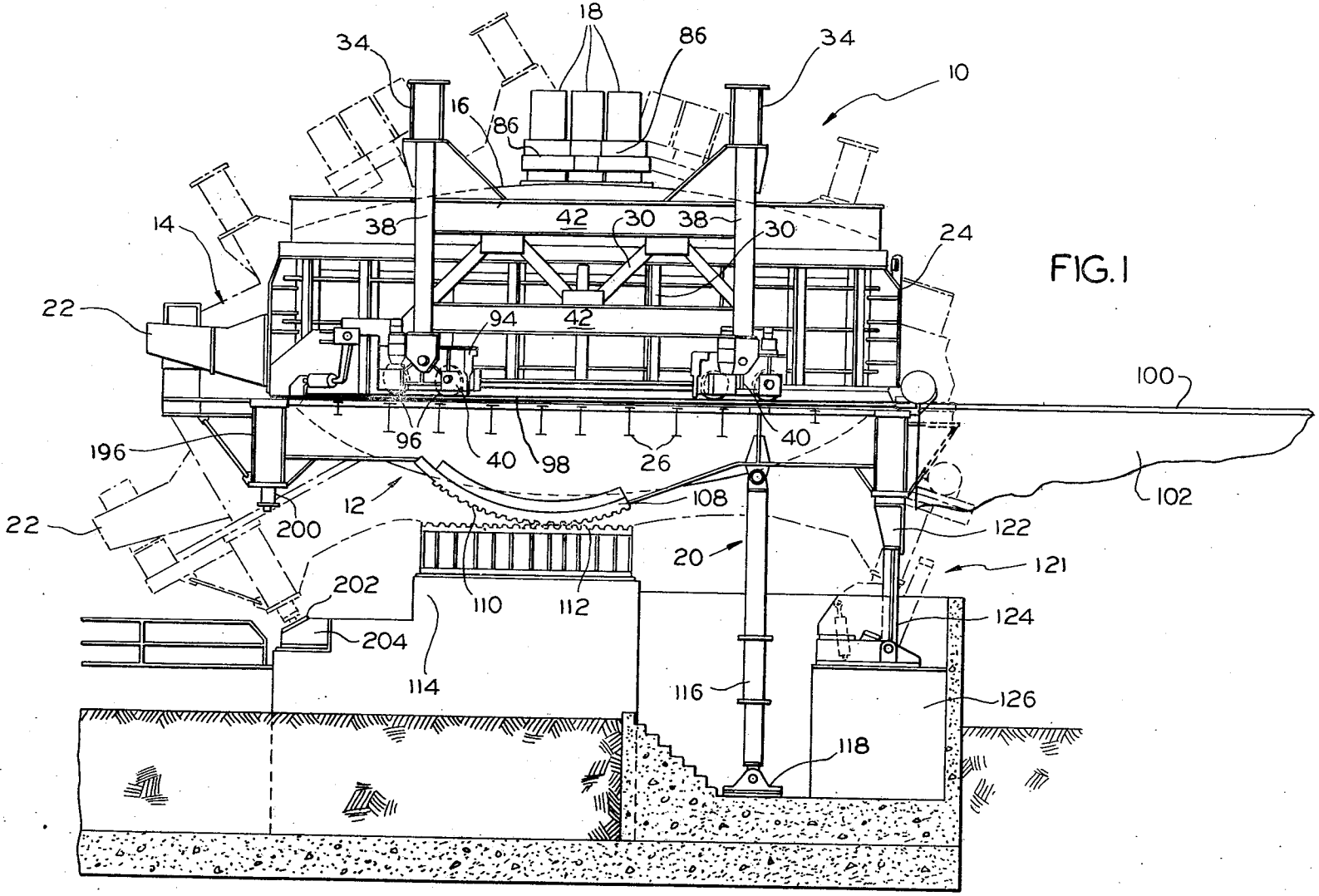
FIG. 1 is a side elevational view of an electric arc furnace incorporating the present invention.
Figure 2:
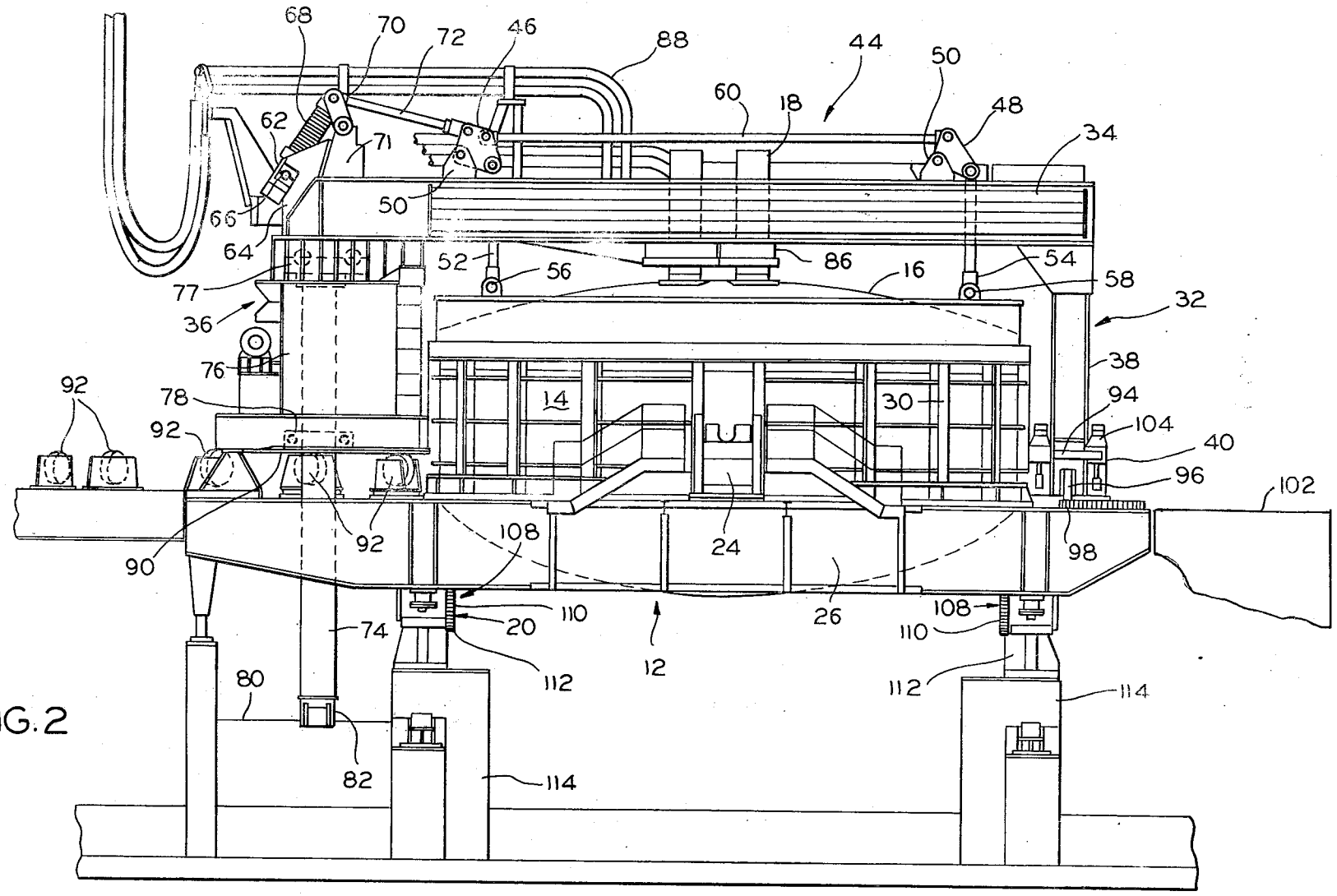
FIG. 2 is a front view of the electric arc furnace shown in FIG. 1.
Figure 3:
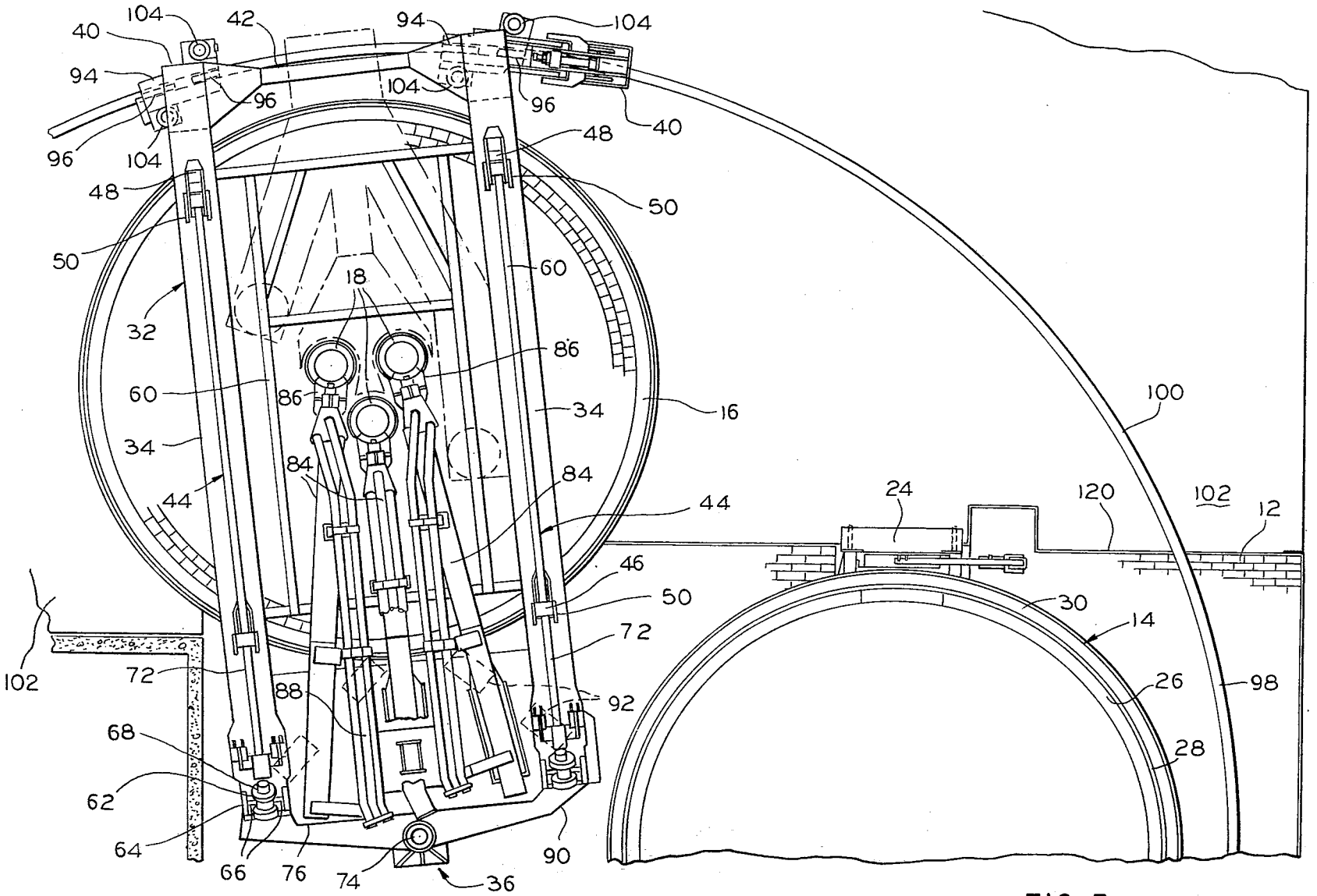
FIG. 3 is a top plan view of a portion of the arc furnace illustrated in FIG. 1.

The furnace assembly 10 according to the preferred embodiment of the invention is shown in FIGS. 1, 2 and 3 to include a platform 12, a furnace body 14 mounted on platform 12, a furnace cover 16 and a plurality of electrodes 18 which extend through suitable openings in cover 16. Platform 12 is mounted on a rocker assembly 20 so that the furnace body 14 may be tilted counterclockwise as viewed in FIG. 1 so that molten metal may be discharged from spout 22 upon the completion of a furnace operation and in addition, the vessel may be tilted clockwise to permit deslagging through slag door 24.

The platform 12 is of conventional construction and includes structural steel members 26 which engage and support the furnace body 14. The arc furnace consisting of the body 14, the roof 16 and the electrodes 18 is of generally conventional construction and accordingly, will not be discussed in detail. It is sufficient for purposes of understanding the invention to state that the body 10 is generally hollow and circular in plan view and includes a refractory lining 26 and a metallic shell 28 which are surrounded by a structural steel framework 30 supported on its lower end by platform 12. The roof 16 is supported by a gantry 32 which includes a pair of horizontally extending beam assemblies 34 which are supported at one end by a pivot assembly 36 and at their other end by vertical posts 38 each having a truck assembly 40 at its lower end. The posts 38 are also joined by suitable cross members 42.

While any suitable mechanism may be provided for elevating the roof 16, in the preferred embodiment, the elevating mechanism consists of a pair of identical elevating assemblies 44, one of which is mounted on each beam 34 and accordingly, only one assembly 44 will be discussed for the sake of brevity. More specifically, elevating mechanism 44 is shown in FIGS. 2 and 3 to include a pair of crank members 46 and 48 which are each pivotally mounted on brackets 50 located adjacent the outboard and inboard ends of beam 34. Crank member 46 is generally rectangular and is pivotally connected at one of its lower corners to bracket 50 and its other lower corner is pivotally connected to the upper end of a vertically extending connecting rod 52. Crank member 48 is generally triangular and pivotally connected at one apex to bracket 50 and at a second apex to the upper end of a second vertically extending rod 54. The lower ends of rods 52 and 54 are each pivotally connected to the furnace cover 16 at points 56 and 58, respectively. A connecting link 60 is pivotally connected at its opposite ends to one corner of crank 46 and to the third apex of crank 48. A hydraulic cylinder 62 is pivotably mounted on a bracket 64 affixed to the inboard end of beam assembly 34 by means of trunnions 66. A rod 68 extends from and is connected to the piston of cylinder 62 and its opposite end is pivotally connected to an arm 70, the lower end of which is also pivotally mounted on a bracket 71 secured to beam 34. A link member 72 also pivotally connects the upper end of arm 70 to crank member 46.

Cylinder 62 is double-acting so that when it is pressurized in a first direction such that rod 68 moves inwardly, each of the cranks 46 and 48 will be rocked counterclockwise as viewed in FIG. 2 so that the cover 16 will be elevated to the agency of rods 52 and 54. On the other hand, when the cover 16 is in an elevated position and cylinder 62 is pressurized in the opposite direction, each of the cranks 46 and 48 will be rocked clockwise to return the cover to its closed position shown in FIG. 2. It will be appreciated that a suitable hydraulic supply system will be provided for being connected to cylinder 62 for providing a pressurized fluid thereto and that suitable means will be provided to retain cover 16 in its elevated position as may be required.

The column assembly 36 includes a vertical column 74 and a column super structure assembly 76 which is coupled to column 74 by means of bearing assemblies 77 and 78. The lower end of column 74 is supported on pier 80 by means of a rocker assembly 82. The electrodes 18 each extend through suitable openings in cover 16 and each is affixed to a generally horizontally extending arm 84 by means of an electrically conductive electrode clamp 86. Each of the arms 84 are suitably mounted on the super structure 76 for individually and collectively raising and lowering the electrodes 18 as furnace conditions dictate. In addition, each of the electrodes 18 may be raised so that they are elevated out of the furnace body 14 to permit the electrodes to pivot along with the furnace cover to their remote position shown in FIG. 3. Suitable bus bars and connectors 88 connect the electrode clamps to a transformer (not shown) for energizing each of the electrodes whereby an arc will be struck between their lower ends and the furnace charge for providing the necessary heat for melting and other metallurgical operations which may be performed within the furnace. The electrodes 18, the arms 84, the clamps 86, the bus bars and connectors, and the apparatus for elevating and lowering arms 84 are all conventional and accordingly, will not be described in detail.

The lower end of the support column super structure includes a bearing plate 90 which rests atop a plurality of roller assemblies 92 which are mounted on the platform 12 in a circular array around and coaxial with the support posts 74.

Each of the trucks 40 includes a frame assembly 94 and a pair of wheels 96 each of which engages a track, a first portion 98 of which is disposed on platform 12 and a second portion 100 of which is disposed on the adjacent support floor 102. Each of the track portions 98 and 100 has a center of curvature coincident with the axis of support post 96 and the adjacent ends of said track portions are in closely spaced relation. Each of the trucks 40 also include motors 104 each of which are constructed and arranged for driving one of the wheels 96.

It will be appreciated from the foregoing description that after the cover 16 and the electrodes 18 have been suitably elevated in the manner described, the motors 104 may be operated to swing the cover, the electrodes, and the gantry 32 about column 74 and from above the furnace body 14 to its remote position shown in FIG. 3. This will expose the furnace body 14 for charging. After the furnace body 14 has been charged, the motors are reversed to return the cover to its position above furnace body 14 whereby the cover 16 and the electrodes 18 may be lowered into their operative positions.

The rocker assembly 20 includes a pair of main rocker segments 108 disposed in parallel spaced apart relation. Each rocker segment 108 has an arcuate lower toothed portion 110 which engages a linear toothed member 112 supported on a pier 114. The center of curvature of toothed portions 110 defines the pivot axis of furnace body 14.

A pair of spaced apart hydraulic tilt cylinders 116 are each mounted in alignment with and below one of the main rocker segments 108 and each is pivotally connected at its upper end to its associated rocker segment 108 and at its lower end to a base 118 supported on pier 114. The tilt cylinders 116 are double-acting whereby the furnace body may be tilted in either direction about its pivot axis as discussed above. Each cylinder 116 is connected to a suitable source of hydraulic fluid (not shown) for controlled pressurization.

Figure 5:
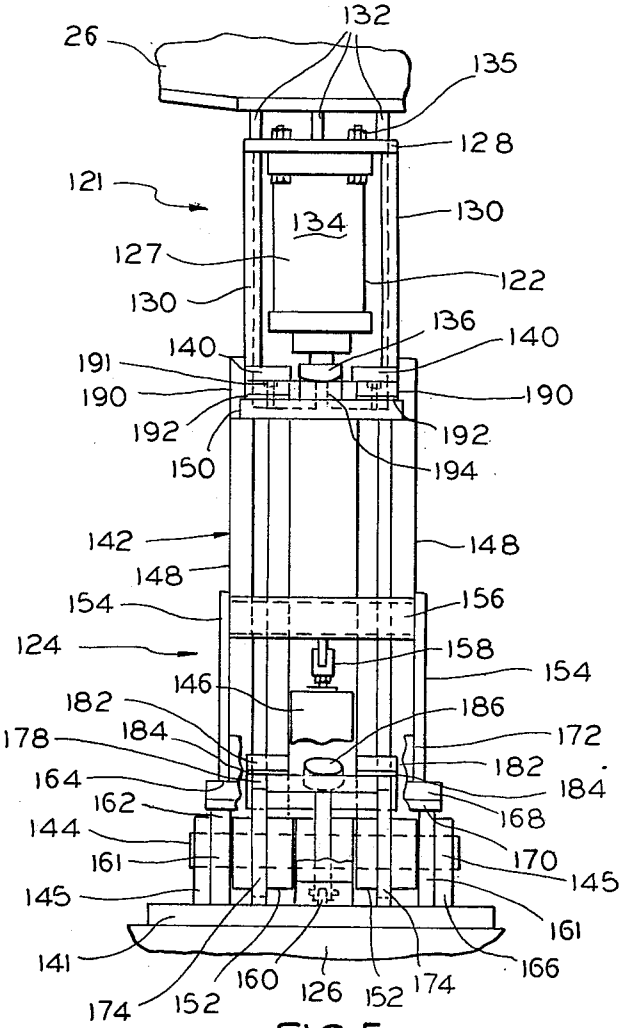
FIG. 5 is a front view with parts broken away of the support assembly illustrated in FIG. 4.
Figure 4:
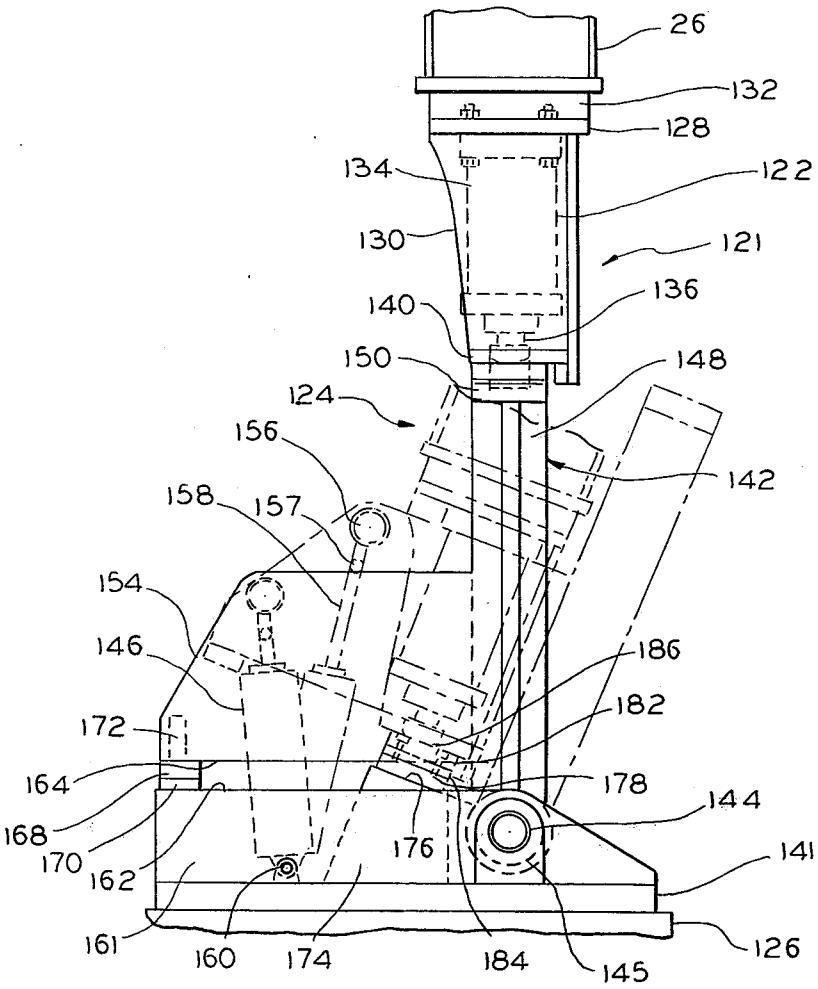
FIG. 4 is a side elevational view of the portion of the support assembly for the arc furnace illustrated in FIG. 1.
Figure 6:
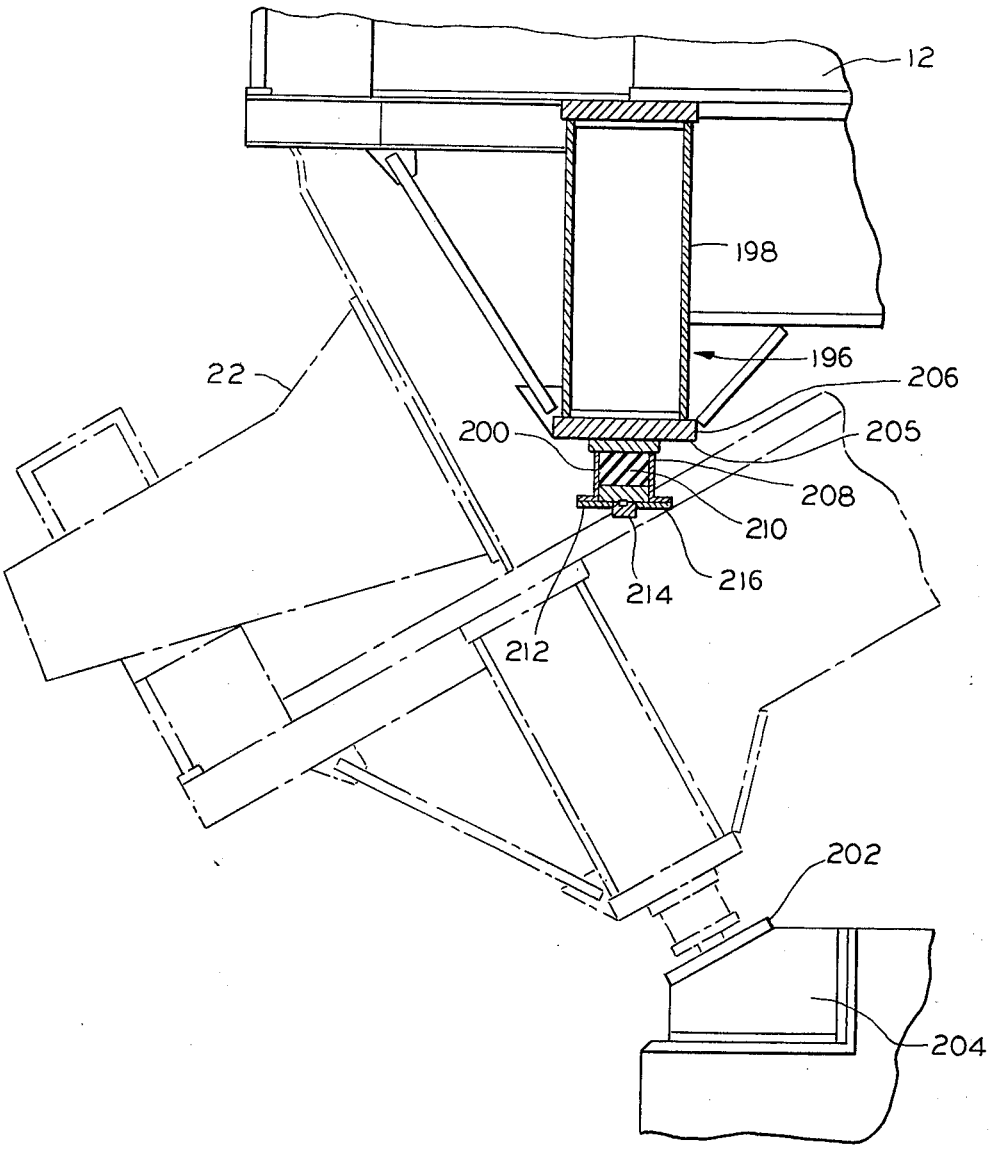
FIG. 6 is a fragmentary view of the portion of the support assembly of the arc furnace illustrated in FIG. 1.

It will be appreciated that as the gantry 32 moves across the edge 120 of platform 12 and onto the adjacent floor 102 when the roof 16 and electrodes 18 are swung to their position shown in FIG. 3, the furnace body 42 and platform 12 will tend to pivot clockwise as seen in FIG. 1. In order to prevent rocking of platform 12 and to maintain the rail segments 98 and 100 in alignment a pair of level assemblies 121 are provided in general alignment with the tilt cylinders 116. Each of the assemblies 121 are shown more particularly in FIGS. 4 and 5 to include a shock absorber 122 supported below platform 12 and a rocker post assembly 124 mounted atop a pier 126.

Shock absorber assembly 122 includes a shock absorber 127 supported below the platform 12 by a mounting bracket assembly 122 consisting of a top plate 128 and a pair of generally parallel side plates 130. Top plate 128 is affixed to the underside of one of the structural members 26 of platform 12 by a plurality of foot plates 132. The shock absorber 122 includes a cylinder 134 suitably attached at its upper end, such as by bolts 135 to the undersurface of top plate 128. Cylinder 134 extends downwardly from top plate 128 and has a plunger 136 extending from its lower end. The lower surface of plunger 136 may be convexly curved for engagement with the rocker post assembly 124 as will be described hereinbelow. Affixed in a generally perpendicular relation at the lower end of each side plate 130 and extending generally inwardly therefrom toward plunger 136 is a bearing plate 140, the lower surfaces of which are coplanar.

The rocker post assembly 124 includes a support base 141 and a support post assembly 142. The lower end of support post assembly 141 is pivotally mounted on a pivot pin 144 extending between brackets 145 projecting upwardly from base 141. A cylinder 146 is coupled to the support post assembly 142 for tilting the same into and out of its supportive position as will be discussed more fully below. Support post assembly 142 includes a pair of spaced apart, elongate, generally parallel columns 148 which are bridged at their upper ends by a top plate 150. Each column 148 has a generally cruciform configuration in transverse cross-section and each has a bearing 152 at its lower end for surrounding pivotal engagement with the pivot pin 144. Affixed to the lateral sides of support columns 148 and spaced above bearings 152 are a pair of side plates 154 which extend forwardly from columns 148 in a generally parallel relation and each has a height substantially smaller than its width. A cylindrical thrust member 156 is affixed to and extends perpendicularly between the side plates 154 and adjacent their remote ends relative to columns 148. Member 156 is connected by an articulated link 157 to the plunger 158 of a cylinder 146. The lower end of cylinder 146 is also pivotally mounted at 160 on support base 141.

A pair of spaced apart bottom plates 161 are affixed to support base 141 and extend forwardly from pivot pin 144 in general parallelism to each other with one being disposed below each side plate 154. Each plates 161 also has an upper edge 162 which extends generally horizontally. Each side plate 154 also has a lower edge 164 which extends perpendicularly from columns 148 and generally parallel to one of the edges 162 of plate 161 when columns 148 are disposed in their vertical position shown by full lines in FIG. 4. A cross member 168 is affixed to and extends between the lower forward edges of side plates 154 and is adapted to engage bearing plates 170 affixed to the adjacent edges 162 of bottom plates 161. A cross brace 172 may also be affixed between the lower portions of side plate 154 and above the cross members 168. It will be appreciated that the rocker post assembly is supported when in its vertical position by the engagement of cross member 168 on the bearing plates 170.

Affixed in parallel spaced apart relation to support base 141 and extending vertically upwardly therefrom at a point forwardly of pivot pin 144 are a pair of rectangular plates 174. The upper edges 176 of plates 174 slope rearwardly toward bearing pin 144 and are bridged by a mounting plate 178 affixed thereto. A pair of bearing plates 182 are attached by screws 183 to plate 178 and adjacent its outer edges. Shim packs 184 are disposed between mounting plate 178 and bearing plates 182 for purposes which will be discussed more fully below. Also affixed to the upper surface of mounting plate 178 and at a point intermediate its ends is a short cylindrical pad 186 whose height is substantially equal to that of the bearing plates 182.

The cylinder 146 may be pneumatic or hydraulic and may be single or double acting. If single acting, the rocker post assembly 124 is preferably gravity biased toward its position shown by full lines in FIG. 4. Toward this end, the center of gravity of assembly 124, therefore, remains on the right side of the axis of pin 144 when in its pivoted position as shown by broken lines in FIG. 4. Accordingly, after assembly 124 has been pivoted, it will return to its upright position when cylinder 146 is depressurized. It will also be appreciated that cylinder 146 will be connected to a suitable source of pressure, not shown, through suitable valves and other controls not shown but well known in the art.

Referring again to the shock absorber assembly 122, a second pair of bearing plates 190 are mounted by screws 191 on the upper surface of top plate 150. Shim packs 192 are disposed between bearing plates 190 and top plate 150 for vertical positioning and a second pressure pad 194 is affixed to top plate 150 between bearing plates 190.

Disposed at the opposite side of platform 12 relative to the level assemblies 121 are a second pair of shock absorber assemblies 196, each of which includes a tubular support 198 and a bumper 200. In addition, a bearing plate 202 is positioned at an angle on pier 14 by bracket 204. Each of the tubular supports 198 are affixed at their upper end to the underside of platform 12 and extend downwardly therefrom. The bumper 200 includes a base plate 205 affixed to the undersurface of a plate 206 mounted on the lower end of support 198 and a hollow housing 208 which extends downwardly from plate 205. Disposed within housing 208 is a compressible material 210 such as rubber. Abutting the lower end of material 210 is a plate 212 which has a block 214 affixed to its outer surface. An apertured cover 216 is affixed to the lower end of housing 208 for retaining the plate 212 within housing 208. Bearing plate 202 is positioned the same distance from the vessel pivot axis as the center line of shock absorber assembly 196 so that when the vessel is tilted counterclockwise as shown in FIG. 1, the block 214 will engage plate 202 compressing the material 210 to arrest pivotal movement of the vessel.

Except as otherwise indicated, the apparatus just discussed may be comprised of suitable steel members which are assembled in any suitable fashion, such as by welding.

In operation, the furnace cover 16 and electrodes 18 will initially be in their positions shown in FIG. 3 whereby the furnace body 14 is open for receiving a furnace charge. After furnace charging has been completed, the gantry motors 104 are actuated to swing the cover 16 and electrodes 18 from their position shown in FIG. 3 to a position above furnace body 14. In order to provide a smooth transition for the gantry wheels 96 as they move from rail segments 100 on floor 102 to rail segments 96 on platform 12, it is necessary for the level assembly 120 to rigidly support platform 12 with the rail surfaces coplanar. This is accomplished by providing shims 192 so that when bearing plates 140 engage the bearing plates 192, the rail segments 98 and 100 are at the same vertical elevation.

After the furnace cover 16 and the electrodes 18 have been positioned above furnace body 14 and lowered into operative position, the melting operation may commence. During the metallurgical process performed within the furnace 10, it may be necessary to deslag. Toward this end, the furnace 10 is tilted clockwise as shown in FIG. 1 to lower slag door 24 and thereby permit slag removal. This is accomplished initially by tilting the furnace 10 slightly counterclockwise to elevate the bearing plates 140 of the shock absorber assemblies 122 from the bearing plates 190 of the rocker post assemblies 122. The rocker posts 124 may then be pivoted clockwise as viewed in FIGS. 1 and 4 after which the platform 12 may be tilted clockwise until the bearing plates 140 engage the bearing plates 182 at which time the assembly will be in the position shown by dashed lines in FIG. 1. Prior to the engagement of bearing plates 140 on bearing plate 182, the plunger 136 of shock absorber 122 will engage the pad 186 to thereby arrest the furnace as it moves to its tilted position.

After deslagging has been completed, the platform 12 may be returned to a substantially horizontal but slightly overtilted position to permit the tilt post assembly 142 to be returned to its vertical position by pressurizing the opposite end of cylinder 146. The platform 12 may then be leveled for further processing. When the metallurgical process within furnace 10 has been completed, the vessel may be tilted counterclockwise as shown in FIG. 1 to bring shock absorber 196 into engagement with plate 202 during which time pouring can proceed. It will be appreciated that during deslagging and pouring, the cover 12, the electrodes 18, and the gantry 32 will all pivot along with the furnace body 14.

While only a single embodiment of the invention has been illustrated and described, it is not intended to be limited thereby but only by the scope of the appended claims.

I claim:

1. An electric arc furnace comprising a platform pivotable about a generally horizontal axis, a generally horizontally extending support floor adjacent said platform, a furnace body mounted on said platform and having electrode means and a removable roof, roof elevating means mounted on said platform and being constructed and arranged to elevate said roof and said electrode means and for swinging the same away from said furnace body and toward one side of said platform, and support means disposed below said platform and on the side thereof toward which said roof and electrode means move, said support means including pivotally mounted first column means, means for pivoting said first column means into and out of a substantially vertical position beneath said platform, bearing means mounted below said platform and adapted to engage said first column means when the same is in its substantially vertical position whereby said platform is supported in general horizontal alignment with said support floor when said roof and electrode means are being swung, said first column means being pivotal in a direction opposite to that in which said platform tilts whereby tilting movement of said first column means will move the same out of the pivotal path of said bearing means to permit said platform to tilt, said roof elevating means including gantry means having beam means extending horizontally above said roof means, second column means supporting said beam means at one end and having roller means adjacent its lower end, means at the opposite side of said furnace body for supporting said beam means for pivotal movement in a plane generally parallel to said platform, and means for pivoting said beam means whereby said roller means move off one side of said platform and onto an adjacent support floor at a point displaced horizontally from the pivot axis of said platform to swing said roof and electrode means away from said furnace body, said first column means being disposed below the one side of said platform so that said pivotal movement of said platform is prevented as said roller means moves across said platform and onto the support floor.

2. The electric arc furnace set forth in claim 1 wherein the bearing means on said platform comprises first bearing means, said first column means including second and third bearing means, said second bearing means being engageable by said first bearing means when said first column means is in a vertical position, said third bearing means being fixedly mounted equidistantly from the pivot axis of said platform as said first bearing means and being disposed at a lower vertical elevation than said second bearing means so that said third bearing means will be engaged by said first bearing means as said platform pivots.

3. The electric arc furnace set forth in claim 2 wherein said platform is tiltable in a first direction for pouring molten metal from said furnace body and in a second direction to permit deslagging, said first column means lying in the pivotal path of said platform as said platform returns to a substantially horizontal position after tilting in said first direction, and shock absorber means mounted below said platform and adjacent said first bearing means, said shock absorber means engaging said first column means to arrest movement of said platform as it pivots in said second direction and toward a vertical position, and pad means disposed adjacent said third bearing means, said shock absorber means being adapted to engage said pad means prior to the engagement of said first bearing means during pivotal movement of said platform in said second direction.

4. The electric arc furnace set forth in claim 3 and including second shock absorber means mounted adjacent the opposite side of said platform relative to said first shock absorber means and stop means fixedly mounted below said platform and equidistant from the pivotal axis of said platform relative to said second shock absorber means, whereby said second shock absorber means will engage said stop means upon pivotal movement of said platform in said first direction.

5. The electric arc furnace as set forth in claim 4 wherein there are a pair of said first column means disposed below said platform and in spaced apart relation and below one side thereof.

6. The arc furnace set forth in claim 5 and including rocker means disposed below said platform and tilt cylinder means engaging said rocker means on the side thereof adjacent said one side of said platform.

7. The electric arc furnace set forth in claim 6 wherein said tilt cylinder means comprises a pair of tilt cylinders disposed between said column means and said rocker and on the same side of the pivot axis of said platform as said column means.

8. The electric arc furnace set forth in claim 7 wherein said furnace body includes a pouring spout on the side of said pivot axis opposite to said first column means and a slag door on the opposite side of said furnace body and above said first column means.

9. The electric arc furnace set forth in claim 1 wherein said platform is tiltable in a first direction for pouring molten metal from said furnace body and in a second direction to permit deslagging, said first column means lying in the pivotal path of said platform as said vessel returns to a substantially horizontal position after tilting in said first direction, and shock absorber means mounted below said platform and adjacent said bearing means, said shock absorber means engaging said first column means to arrest movement of said platform as it pivots in said second direction and toward a horizontal position.

10. The electric arc furnace set forth in claim 9 and including shock absorber means mounted adjacent the opposite side of said platform relative to said first shock absorber means and stop means fixedly mounted below said platform and equidistant from the pivotal axis of said platform relative to said second shock absorber means, whereby said second shock absorber means will engage said stop means upon pivotal movement of said platform in said first direction.

11. An electric arc furnace comprising a tiltable platform, a furnace body mounted on said platform and having electrode means in a removable roof, roof elevating means mounted on said platform and constructed and arranged to elevate said roof and said electrode means and for swinging the same away from said furnace body and toward one side of said platform, and a plurality of support means disposed below said platform and on the side thereof toward which said roof and electrode means move, each of said support means including pivotally mounted column means, a first plurality of bearing means, one being mounted on each said column means, means for pivoting each said column means into and out of a blocking position beneath said platform, a second plurality of bearing means mounted below said platform and each being adapted to engage one of the bearing means on said column means when the same are in their blocking positions whereby said platform is supported horizontally when said roof and electrode means are being swung, said column means being pivotal in a direction opposite to that in which said platform tilts whereby when said column means is tilted, it will move out of the pivotal path of said bearing means to permit said platform to tilt, and a third plurality of bearing means fixedly mounted equidistant from the pivot axis of said platform as said second bearing means and being disposed at a lower vertical elevation than said first bearing means so that said third bearing means when being engaged by said second bearing means as said platform pivots, said platform being tiltable in a first direction for pouring molten metal from said furnace body and in a second direction to permit deslagging, said column means lying in the pivotal path of said platform as said furnace body returns to a substantially horizontal position after tilting in said first direction, shock absorber means mounted below said platform and adjacent said second bearing means, said shock absorber means engaging said column means to arrest movement of said platform as it pivots in said second direction and toward a vertical position, pad means disposed adjacent said third bearing means, said shock absorber means being adapted to engage said pad means prior to the engagement of said first bearing means on said third bearing means during pivotal movement in said second direction, and second shock absorber means mounted adjacent the opposite side of said platform relative to said first shock absorber means and stop means fixedly mounted below said platform and equidistant from the pivotal axis of said platform relative to said second shock absorber means, whereby said second shock absorber means will engage said stop means upon pivotal movement of said platform in said first direction.

* * * * *